US009068791B2

(12) United States Patent
McPherson

(10) Patent No.: US 9,068,791 B2
(45) Date of Patent: Jun. 30, 2015

(54) CROSSBOW CABLE GUIDE

(71) Applicant: MCP IP, LLC, Sparta, WI (US)

(72) Inventor: Mathew McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/021,751

(22) Filed: Sep. 9, 2013

(65) Prior Publication Data

US 2014/0069402 A1 Mar. 13, 2014

Related U.S. Application Data

(60) Provisional application No. 61/699,271, filed on Sep. 10, 2012.

(51) Int. Cl.
*F41B 5/12* (2006.01)
*F41B 5/14* (2006.01)

(52) U.S. Cl.
CPC ..... *F41B 5/123* (2013.01); *F41B 5/1426* (2013.01); *F41B 5/12* (2013.01); *F41B 5/148* (2013.01)

(58) Field of Classification Search
CPC ..... F41B 5/123; F41B 5/12; F41B 5/1426
USPC ..... 124/25, 25.6, 86, 88
See application file for complete search history.

(56) References Cited

U.S. PATENT DOCUMENTS

| | | | | |
|---|---|---|---|---|
| 577,641 | A | | 2/1897 | Bruder |
| 2,500,509 | A | | 3/1950 | Bailey |
| 2,609,810 | A | | 9/1952 | Gruner |
| 2,918,050 | A | * | 12/1959 | Kopman ..... 124/25 |
| D283,637 | S | | 4/1986 | Williams |
| 4,587,944 | A | | 5/1986 | Barnett |
| 4,649,891 | A | * | 3/1987 | Bozek ..... 124/25 |
| 4,693,228 | A | * | 9/1987 | Simonds et al. ..... 124/25 |
| 4,722,318 | A | * | 2/1988 | Yankey ..... 124/25 |
| H486 | H | | 7/1988 | Savioli |
| 4,879,987 | A | * | 11/1989 | Nishioka ..... 124/25 |
| 5,119,797 | A | * | 6/1992 | Anderson ..... 124/25 |
| 5,358,292 | A | * | 10/1994 | Van Wiebe et al. ..... 292/235 |
| 5,490,492 | A | * | 2/1996 | Savage ..... 124/44.5 |
| 5,651,355 | A | * | 7/1997 | Gallops, Jr. ..... 124/25.6 |
| 5,791,324 | A | * | 8/1998 | Johnson ..... 124/25.6 |
| 5,983,880 | A | * | 11/1999 | Saunders ..... 124/25.6 |
| 6,560,911 | B2 | | 5/2003 | Sharp |
| 6,651,641 | B1 | * | 11/2003 | Bower et al. ..... 124/25 |
| 6,792,930 | B1 | * | 9/2004 | Kronengold et al. ..... 124/25.6 |
| 7,174,884 | B2 | | 2/2007 | Kempf et al. |
| 7,328,693 | B2 | | 2/2008 | Kempf |
| 7,363,921 | B2 | | 4/2008 | Kempf |
| 7,441,555 | B1 | * | 10/2008 | Larson ..... 124/25.6 |
| 7,708,001 | B2 | * | 5/2010 | Kempf ..... 124/25.6 |
| 7,832,386 | B2 | * | 11/2010 | Bednar et al. ..... 124/25 |
| 7,836,871 | B2 | | 11/2010 | Kempf |
| 7,930,849 | B2 | | 4/2011 | Abraham et al. |
| 8,191,541 | B2 | * | 6/2012 | Shaffer et al. ..... 124/25 |
| 8,622,050 | B2 | * | 1/2014 | Goff et al. ..... 124/25 |
| 8,627,811 | B1 | * | 1/2014 | Darlington ..... 124/25 |

(Continued)

*Primary Examiner* — Melba Bumgarner
*Assistant Examiner* — Alexander Niconovich
(74) *Attorney, Agent, or Firm* — Vidas, Arrett & Steinkraus

(57) ABSTRACT

In some embodiments, a crossbow comprises a stock, a bow portion and a cable guide member. The bow portion comprises a power cable and a second cable. The cable guide member comprises a first channel and a second channel. At least a portion of the first channel is non-parallel to the second channel.

19 Claims, 5 Drawing Sheets

(56) References Cited

U.S. PATENT DOCUMENTS

| | | | | |
|---|---|---|---|---|
| 8,656,899 | B2 * | 2/2014 | Bednar et al. | 124/25 |
| 8,671,923 | B2 * | 3/2014 | Goff et al. | 124/25 |
| 8,813,737 | B2 * | 8/2014 | Langley | 124/88 |
| 8,991,375 | B2 * | 3/2015 | McPherson | 124/25 |
| 2002/0020403 | A1 | 2/2002 | Troubridge | |
| 2002/0096160 | A1 * | 7/2002 | Gallops, Jr. | 124/25.6 |
| 2005/0279338 | A1 * | 12/2005 | Dziekan | 124/25 |
| 2007/0101631 | A1 | 5/2007 | Bentley | |
| 2007/0289190 | A1 | 12/2007 | Oz | |
| 2008/0168969 | A1 | 7/2008 | Kempf | |
| 2009/0194086 | A1 | 8/2009 | Kempf | |
| 2010/0116259 | A1 * | 5/2010 | Popov et al. | 124/25 |
| 2010/0186728 | A1 | 7/2010 | Bednar et al. | |
| 2010/0263650 | A1 * | 10/2010 | Dahl et al. | 124/25.6 |
| 2010/0269807 | A1 | 10/2010 | Kempf | |
| 2011/0016764 | A1 | 1/2011 | Cales | |
| 2011/0030666 | A1 * | 2/2011 | Darlington | 124/25 |
| 2011/0203561 | A1 * | 8/2011 | Shaffer et al. | 124/25 |
| 2011/0232619 | A1 | 9/2011 | Bednar et al. | |
| 2012/0006311 | A1 * | 1/2012 | Bednar et al. | 124/25 |
| 2013/0055997 | A1 * | 3/2013 | Badgerow | 124/88 |

* cited by examiner

CROSSBOW CABLE GUIDE

CROSS-REFERENCE TO RELATED APPLICATIONS

This application claims the benefit of U.S. Provisional Patent Application No. 61/699,271, filed Sep. 10, 2012, the entire disclosure of which is hereby incorporated herein by reference.

BACKGROUND OF THE INVENTION

This invention relates generally to crossbows and more particularly to a cabling arrangement that provides for more balanced forces.

Crossbows are generally known in the art. Crossbows typically include a bow assembly portion mounted on a stock portion, which typically includes a string latch and trigger assembly for holding a drawn crossbow string and selectively releasing it.

When a bow portion comprises a compound bow, often multiple cables are held away from the shooting axis by a portion of the stock. In general, an aperture or slot is simply provided in the stock, and the cables move through the aperture or slot as the bow is drawn and/or fired.

There remains a need for crossbow cabling arrangements that provide for a more balanced crossbow system.

There remains a need for crossbow cabling arrangements that reduce wear on cables routed through the stock.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a stock, a bow portion and a cable guide member. The bow portion comprises a power cable. The cable guide member is arranged to guide the power cable, and at least a portion of the cable guide member is positioned between the stock and the power cable In some embodiments, the cable guide member is moveable with respect to the stock. In some embodiments, the cable guide member slides along a length of the stock. In some embodiments, the cable guide member comprises flange sidewalls arranged to abut the stock.

In some embodiments, the cable guide member comprises a first channel and the power cable is oriented in the first channel. In some embodiments, the cable guide member comprises a second channel oriented non-parallel to the first channel. In some embodiments, the first channel and the second channel have different depths. In some embodiments, the first channel crosses the second channel. In some embodiments, a second cable is oriented in the second channel.

In some embodiments, the cable guide member is formed from a single piece of material. In some embodiments, the cable guide member comprises a low friction material.

In some embodiments, the cable guide member passes through an aperture formed in the stock.

In some embodiments, a crossbow comprises a stock, a bow portion and a cable guide member. The bow portion comprises a first cable and a second cable. The cable guide member comprises a first channel and a second channel. The first cable is oriented in the first channel and the second cable is oriented in the second channel.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
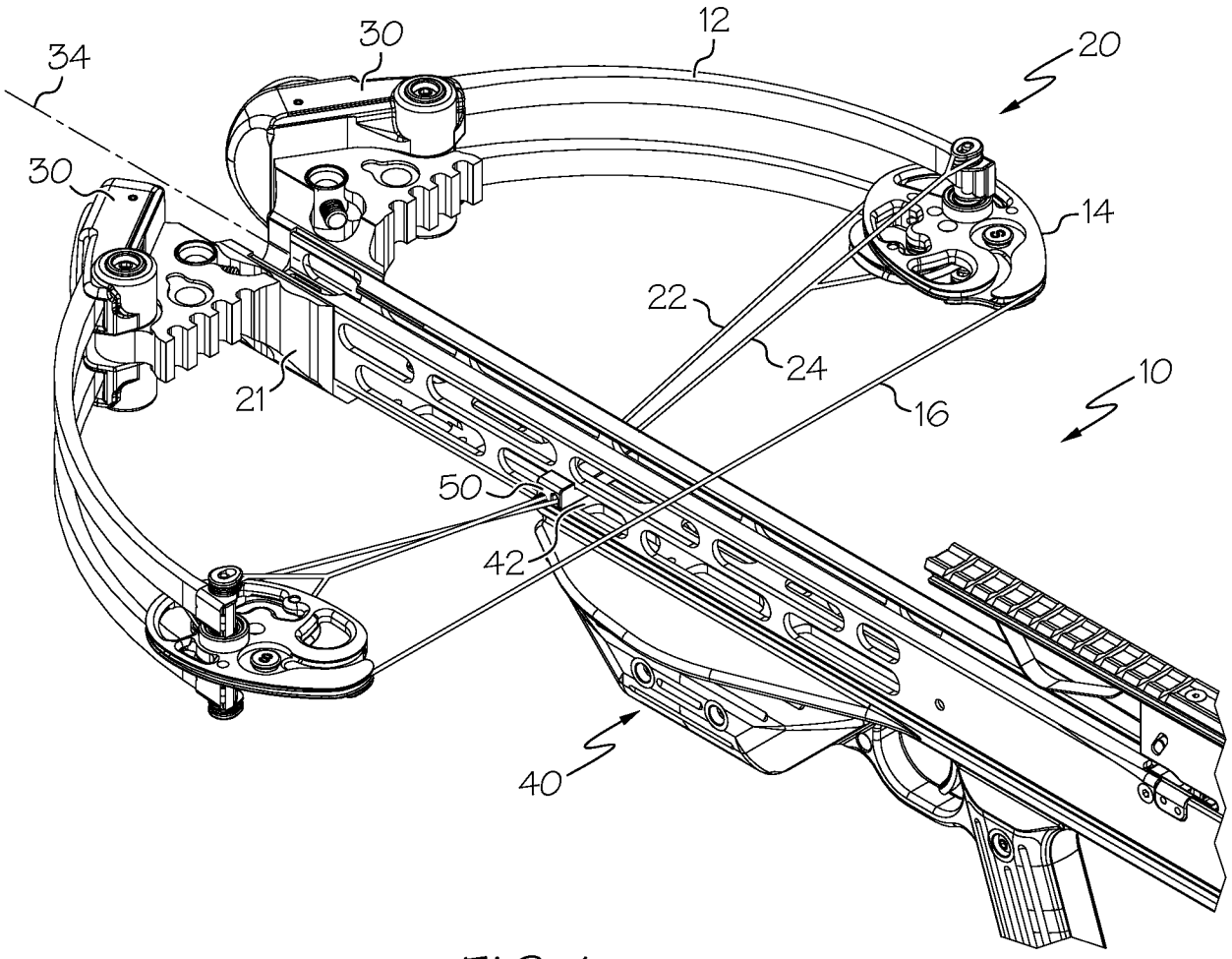
FIG. 1 shows an embodiment of a crossbow.
Figure 2A:
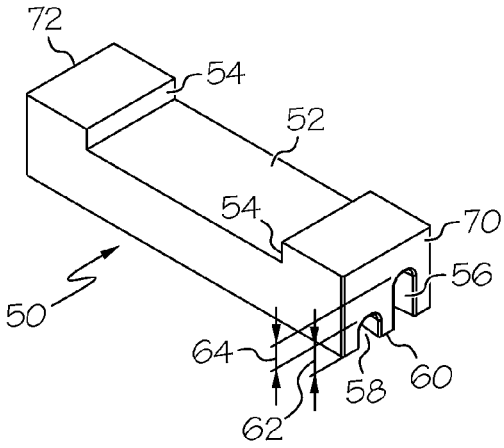
FIGS. 2A-2E show several views of an embodiment of a cable guide member.
Figure 2B:
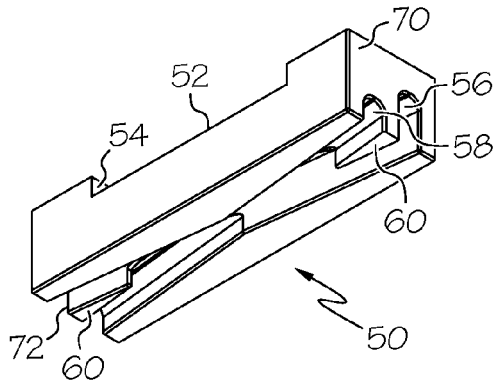
Figure 2C:
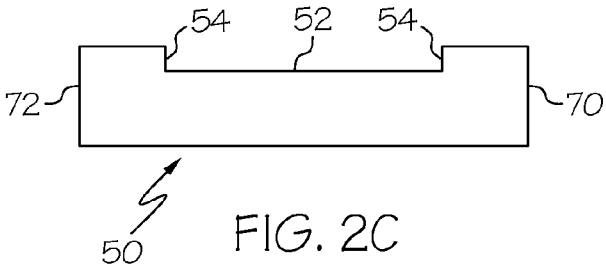
Figure 2D:
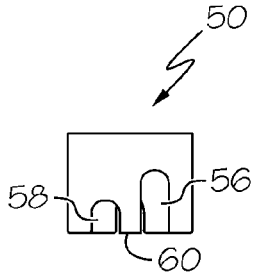
Figure 2E:
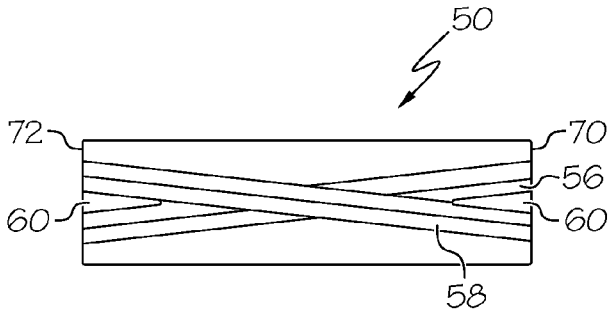

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10 comprising a compound bow portion 20 and a stock portion 40. The bow portion 20 can comprise any suitable type of compound bow structure. In some embodiments, the bow portion 20 comprises limbs 12, rotatable members 14 and a bowstring 16. In some embodiments, the bow portion 20 comprises a prod 21 arranged to attach to the stock portion 40, for example as disclosed in U.S. Application No. 61/699,244, the entire disclosure of which is hereby incorporated herein by reference. In some embodiments, a bow portion 20 comprises one or more limb cups 30, for example as disclosed in U.S. Pat. No. 8,453,635, the entire disclosure of which is hereby incorporated herein in its entirety. A limb cup 30 can attach between a prod 21 and a limb 12.

In some embodiments, the bow portion 20 comprises a first cable 22 and a second cable 24 that extend between the rotatable members 14. In some embodiments, the bow portion 20 comprises a dual cam bow wherein both rotatable members 14 comprise cams, and cables 22, 24 each comprise a power cable. In such embodiments, the rotatable members 14 and cables 22, 24 can be mirrored across a shooting axis 34, desirably providing a system that is substantially laterally balanced. A bow portion 20 can comprise any suitable type of two-cam bow.

In some embodiments, the bow portion 20 comprises another suitable compound bow configuration, such as a single-cam bow or 1.5/hybrid/CPS cam bow. In these embodiments, the first cable 22 will generally comprise a power cable and the second cable 24 comprises a control/secondary cable.

Desirably, the cables 22, 24 are held away from the shooting axis 34, for example by passing through an aperture 42 in the stock portion 40, wherein the structure of the stock portion 40 biases the cables 22, 24. As the crossbow 10 is drawn, the limbs 12 flex and change shape, resulting in movement of the cables 22, 24. Desirably, the aperture 42 is of a suitable size to allow for the movement of the cables 22, 24 (e.g. in a direction along the shooting axis 34, as the rotatable members 14 change position as the limbs 12 flex.

Desirably, a cable guide member 50 is provided. Desirably, a cable guide member 50 will further aid in positioning the cables 22, 24 and will help to prevent wear on the cables 50. In some embodiments, the cable guide member 50 comprises a material having a low coefficient of friction, which allows components of the crossbow 10 to move. For example, the cables 22, 24 can slide through the cable guide member 50 as the bow portion 20 is drawn. In some embodiments, the cable guide member 50 can move with respect to the stock portion 40.

In some embodiments, a cable guide member 50 is rotatable with respect to the stock portion 40. In some embodiments, a cable guide member 50 is slideable with respect to the stock portion 40. In some embodiments, a cable guide member 50 slides along a length of the stock portion 40. In some embodiments, a cable guide member 50 moves in a direction parallel to the shooting axis 34 as the bow portion 20 is drawn. In some embodiments, a cable guide member 50 moves about within an aperture 42 in the stock 40.

Desirably, at least a portion of the cable guide member 50 is positioned between the stock 40 and a cable 22, 24.

In some embodiments, a cable guide member 50 is secured to the stock portion 40 only via force applied by the cables 22, 24. For example, as shown in FIG. 1, the cables 22, 24 are in tension, and force applied to the cable guide member 50 by the cables 22, 24 holds the cable guide member 50 against the stock portion 40.

In some embodiments, the position of the cable guide member 50 with respect to the stock 40 is controlled by the cables 22, 24. For example, the cable guide member 50 will assume whatever position allows for equilibrium of forces in the crossbow 10. As the bow portion 20 is drawn, the position of the cables 22, 24 may shift, and the cable guide member 50 can move with the cables 22, 24. In some embodiments, a cable guide member 50 is oriented in a first position with respect to the stock 40 when the bow portion 20 is undrawn, and the cable guide member 50 is oriented in a second position with respect to the stock 40 when the bow portion 20 is drawn.

FIGS. 2A-2E show several views of an embodiment of a cable guide member 50. In some embodiments, the cable guide member 50 comprises a notch 52, and a portion of the stock 40 is oriented in the notch 52. In some embodiments, one or more flange portions 54 are provided, which can be arranged to abut the stock 40. In some embodiments, opposed flanges 54 are provided on each side of the cable guide member 50, and the flanges 54 straddle the stock 54. This provides an engagement between the cable guide member 50 and the stock 40, preventing the cable guide member 50 from moving laterally with respect to the stock 40 but allowing the cable guide member 50 to traverse along a length of the stock 40.

In some embodiments, the cable guide member 50 comprises a first channel 56 arranged to receive a first cable 22. In some embodiments, the first cable 22 slides in the first channel 56 (e.g. in a lengthwise direction of the cable 22) as the bow portion 20 is drawn. In some embodiments, the cable guide member 50 comprises a second channel 58 arranged to receive a second cable 24. In some embodiments, the second cable 24 slides in the second channel 58 (e.g. in a lengthwise direction of the cable 24) as the bow portion 20 is drawn.

In some embodiments, a channel 56, 58 is straight along its length. In some embodiments, a channel 56, 58 can include curvature, or can comprise one or more straight portions and one or more curved portions. In some embodiments, at least a portion of the first channel 56 extends in a direction non-parallel to a portion of the second channel 58. In some embodiments, a straight first channel 56 extends in a direction non-parallel to a straight second channel 58. In some embodiments, a central longitudinal axis of the first channel 56 is non-parallel to a central longitudinal axis of the second channel 58.

In some embodiments, each channel 56, 58 extends from a first side 70 of the cable guide member 50 to a second side 72. In some embodiments, the first and second channels 56, 58 are each defined as grooves in the cable guide member 50.

In some embodiments, the channels 56, 58 cross within the cable guide member 50, such that the orientation of the cables 22, 24 on the first side 70 is different from their orientation on the second side 72. For example, a first power cable 22 can be oriented in the first channel 56 and a second power cable 24 can be oriented in the second channel 58. The first channel 56 can be located forward of the second channel 58 on the first side 70, and the second channel 58 can be located forward of the first channel 56 on the second side 72. Thus, in some embodiments, the channels 56, 58 form an X-shape (e.g. when viewed from above or below). In some embodiments, the channels 56, 58 cross with their intersection/overlap located at the center of the cable guide member 50 (e.g. a center of the X coincides with a center of the cable guide member 50 when the crossbow 10 is viewed from the top or bottom). In some embodiments, the crossing of channels 56, 58 is also aligned vertically with the shooting axis 34, which helps to balance forces laterally.

In some embodiments, the channels 56, 58 are provided at different heights or depths, allowing the cables 22, 24 to cross without contacting or interfering with one another. For example, the first channel 56 can be provided having a first depth, and the second channel 58 can be provided having a second depth, wherein the first depth is greater than the second depth.

In some embodiments, the second channel 58 comprises a depth 62 that is equal to or slightly larger than a diameter of the second cable 24. In some embodiments, the first channel 56 has twice the depth of the second channel 58.

In some embodiments, a first channel 56 comprises a first depth portion 62 and a second depth portion 64, wherein the first depth portion 62 is equal to the depth of the second channel 58, and the second depth portion 64 provides for additional depth for the first cable 22. In some embodiments, the depth of the second depth portion 64 is equal to or slightly larger than a diameter of the first cable 22.

In some embodiments, a cable guide member 50 comprises one or more divider portions 60 located between the first channel 56 and second channel 58.

A cable guide member 50 can be made from any suitable material using any suitable method. In some embodiments, a cable guide member 50 is formed from a single piece of material. In some embodiments, a cable guide member 50 comprises a polymer. In some embodiments, a cable guide member 50 is formed by a molding process. In some embodiments, a cable guide member 50 comprises a low friction material such as polytetrafluoroethylene.

In some embodiments, one or more portions of the cable guide member 50 in contact with another portion of the crossbow 10 are coated with a low friction material. For example, the channels 56, 58 can be coated to reduce friction with the cables 22, 24. Surfaces of the cable guide member 50 that contact the stock 40 can also be coated.

In some embodiments, the channels 56, 58 are formed in one surface of the cable guide member 50 (e.g. a bottom surface), and a notch 52 is formed in an opposite surface (e.g. a top surface).

Figure 3:
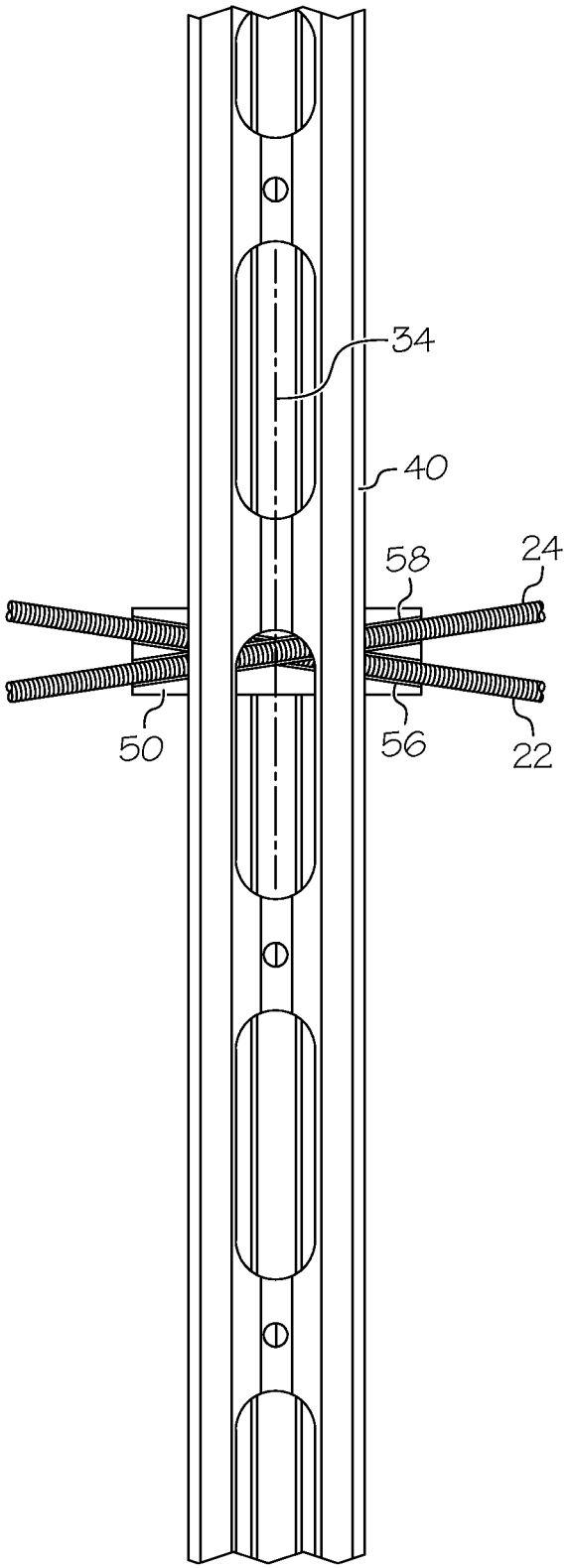
FIG. 3 shows a bottom view of an embodiment of a cable guide member and cables oriented therein.

FIG. 3 shows a bottom view of an embodiment of a crossbow 10, showing an embodiment of a cable guide member 50 and cables 22, 24 oriented therein.

Figure 4:
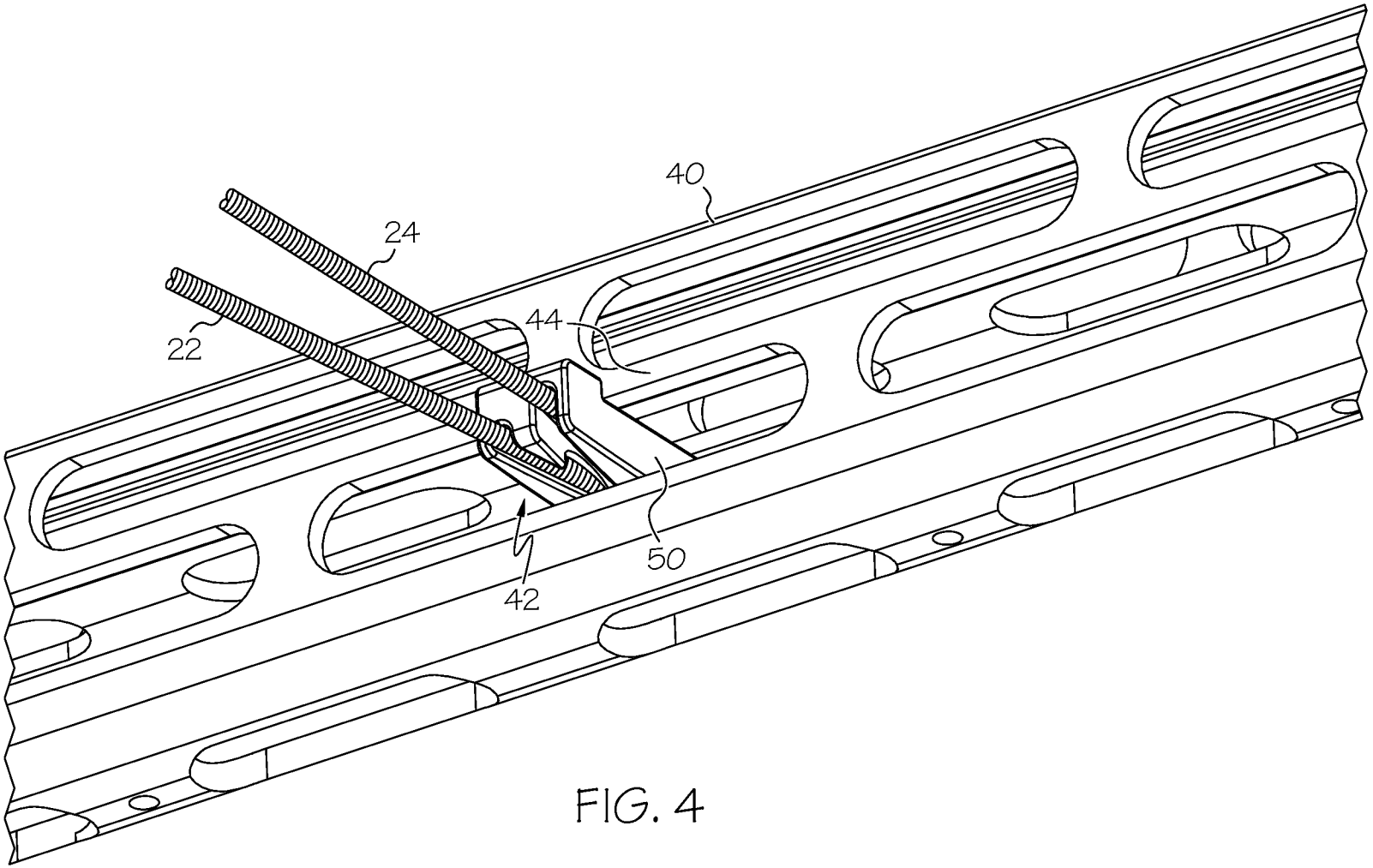
FIG. 4 shows another view of an embodiment of a cable guide member.

FIG. 4 shows an embodiment of a cable guide member 50 and an embodiment of a stock 40. In some embodiments, the stock 40 is provided with a flange 44, and a surface of the cable guide member 50 can abut and/or slide along the flange 44. In some embodiments, a flange 44 is provided on each side of the stock 40. In some embodiments, a flange 44 is located next to an aperture 42.

Figure 5A:
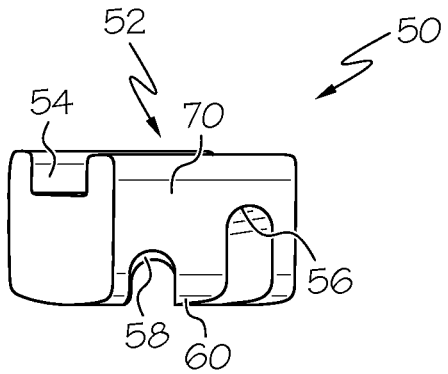
FIGS. 5A-5C show additional views of an embodiment of a cable guide member.
Figure 5B:
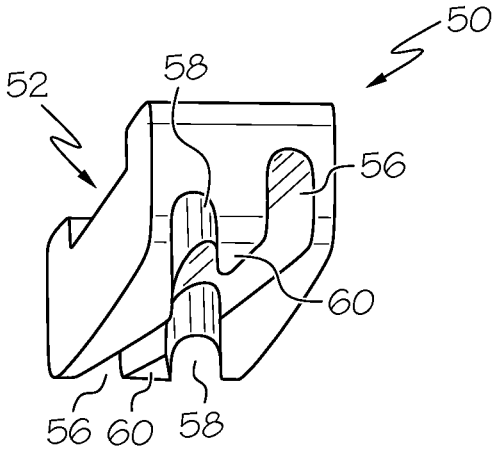
Figure 5C:
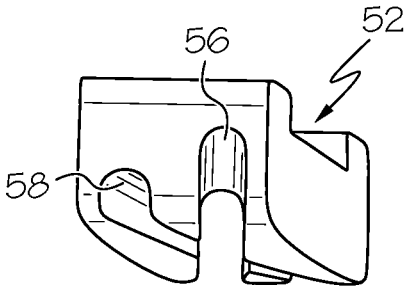

FIGS. 5A-5C show additional views of an embodiment of a cable guide member 50.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock comprising opposed external surfaces defining a width;

a bow portion comprising a power cable and a second cable; and a cable guide member arranged to guide said power cable, said cable guide member being wider than said stock and extending outwardly from said stock, said cable guide member comprising opposed flange sidewalls, said cable guide member comprising a first channel and a second channel, said power cable oriented in said first channel, said second cable oriented in said second channel;

wherein said first channel is non-parallel to said second channel, said first channel and said second channel have different depths and said opposed flange sidewalls are arranged to abut said opposed external surfaces.

2. The crossbow of claim 1, wherein said cable guide member is moveable with respect to said stock.

3. The crossbow of claim 2, wherein said cable guide member slides along a length of said stock.

4. The crossbow of claim 1, wherein said cable guide member comprises a divider located between said first channel and said second channel.

5. The crossbow of claim 1, wherein a central axis of said first channel is non-parallel to a central axis of said second channel.

6. The crossbow of claim 5, wherein said power cable slides in said first channel as said crossbow is drawn.

7. The crossbow of claim 1, wherein said first channel crosses said second channel.

8. The crossbow of claim 7, wherein an overlap of said first channel and said second channel is centered in said cable guide member.

9. The crossbow of claim 8, wherein said overlap is aligned with a shooting axis of the crossbow.

10. The crossbow of claim 7, said cable guide member comprising a first divider located between said first channel and said second channel at a first location and a second divider located between said first channel and said second channel at a second location.

11. The crossbow of claim 1, wherein said cable guide member is formed from a single piece of material.

12. The crossbow of claim 1, wherein said cable guide member is oriented in a first position with respect to said stock when said crossbow is undrawn, and said cable guide member is oriented in a second position with respect to said stock when said crossbow is drawn.

13. A crossbow comprising:

a stock;

a bow portion comprising a power cable and a second cable; and a cable guide member arranged to guide said power cable, said cable guide member comprising a first channel and a second channel, said power cable oriented in said first channel, said second cable oriented in said second channel;

wherein said first channel is non-parallel to said second channel and said cable guide member comprises a divider located between said first channel and said second channel; and wherein said cable guide member comprises a notch defined by opposed flanges, a portion of said stock is oriented in said notch and said opposed flanges extend outwardly from said stock and contact opposed outer surfaces of said stock.

14. A crossbow comprising:

a stock;

a bow portion comprising a first cable and a second cable; and a cable guide member comprising a notch, a first channel and a second channel, at least a portion of said first channel being non-parallel to at least a portion of said second channel, said first cable oriented in said first channel, said second cable oriented in said second channel;

wherein a width of said cable guide member is greater than a width of said stock, said notch is defined by opposed flanges that extend outwardly from said stock, a portion of said stock is oriented in said notch and said opposed flanges contact opposed outer surfaces of said stock.

15. The crossbow of claim 14, wherein said cable guide member passes through an aperture in said stock.

16. The crossbow of claim 14, wherein said first channel and said second channel have different depths.

17. The crossbow of claim 14, wherein said first channel and said second channel cross one another in the cable guide member.

18. The crossbow of claim 17, wherein an overlap of said first channel and said second channel is centered in said cable guide member.

19. The crossbow of claim 14, wherein said cable guide member is moveable with respect to said stock.

* * * * *